United States Patent [19]

Nagel

[11] 4,287,517

[45] Sep. 1, 1981

[54] CIRCUIT FOR ELIMINATING LOW BATTERY VOLTAGE ALARM SIGNAL AT NIGHT

[75] Inventor: Richard A. Nagel, West Chicago, Ill.

[73] Assignee: Pittway Corporation, Aurora, Ill.

[21] Appl. No.: 115,606

[22] Filed: Jan. 25, 1980

[51] Int. Cl.[3] ..... G08B 21/00; G08B 17/10

[52] U.S. Cl. ..... 340/636; 250/214 AL; 340/628

[58] Field of Search ..... 340/636, 663, 628; 250/239, 214 AL; 361/176, 175; 315/149, 159, 156

[56] References Cited

U.S. PATENT DOCUMENTS

| | | | |
|---|---|---|---|
| 3,811,123 | 5/1974 | Hamm et al. | 340/628 |
| 3,899,732 | 8/1975 | Staby | 340/636 X |
| 4,004,288 | 1/1977 | Webb, Jr. | 340/629 |
| 4,084,156 | 4/1978 | Wittlinger | 340/629 |
| 4,086,525 | 4/1978 | Ibsen et al. | 340/636 X |
| 4,112,310 | 9/1978 | Malinowski | 340/630 X |

OTHER PUBLICATIONS

Practical Electronics; vol. 12, No. 5; p. 421; May 1976.
Radio and Electronics Constructor; vol. 29, No. 3; pp. 174–175; Oct. 1975.
Radio and Electronics Constructor; vol. 30, No. 8; pp. 475–477; Mar. 1977.

*Primary Examiner*—John W. Caldwell, Sr.
*Assistant Examiner*—Daniel Myer
*Attorney, Agent, or Firm*—Vogel, Dithmar, Stotland, Stratman & Levy

[57] ABSTRACT

A battery-operated smoke alarm includes an alerting signal means for indicating when the battery voltage is low by comparing a first signal which is a function of the battery output voltage with a relatively fixed reference signal and producing an alerting signal when the first signal is less than the reference signal. Means are provided for squelching the low battery voltage alerting signal for the first several nights after the onset of the low battery voltage condition by incorporating photosensitive means in the generating circuit for either the first signal or the reference signal for shifting the level of that signal away from the other signal under dark conditions.

13 Claims, 6 Drawing Figures

CIRCUIT FOR ELIMINATING LOW BATTERY VOLTAGE ALARM SIGNAL AT NIGHT

BACKGROUND OF THE INVENTION

The present invention relates to combustion products detectors and alarms and, in particular, to battery voltage monitor circuits for such detectors.

Most combustion products detectors are battery-powered to prevent the unit from being disabled in the event of an AC power failure. Both because of the small drain placed on the battery in maintaining the combustion products detector in a ready condition, and because of the limited shelf life of storage batteries, the energy level of the battery will gradually decrease over time. Accordingly, it is important that the user be able to monitor the energy level of the battery so as to be alerted when the energy level approaches a level beneath which it will be insufficient to power the combustion products detector since, at or before that level, the battery must be replaced if the combustion products detector is to remain operative.

Battery energy level monitoring devices are well-known in the art, one such device which monitors the output voltage of the battery in a combustion products detector being disclosed in U.S. Pat. No. 4,004,288. The difficulty with such prior art battery voltage monitoring circuits is that they will faithfully generate an audible alarm signal whenever the output voltage of the battery reaches the trouble level, and will continually generate the signal until the battery is replaced or until its output voltage becomes insufficient to power the battery voltage monitoring circuit. When the battery voltage alarm signal occurs in the middle of the night, it can be quite inconvenient and annoying. Sometimes the annoyance is such that the user will disable the system to silence it, and then forget that he has done so, thereby rendering the system useless.

SUMMARY OF THE INVENTION

The present invention relates to an improved battery voltage monitor circuit which avoids the disadvantages of prior art devices.

More particularly, it is a general object of this invention to provide a battery voltage alarm circuit wherein the alarm signal is automatically disabled at night.

It is another object of this invention to provide a battery voltage alarm circuit of the type set forth, which is automatically re-enabled in the daytime.

In connection with the foregoing object, it is another object of this invention to provide a battery voltage alarm circuit of the type set forth, wherein the alarm signal is periodically disabled at night and re-enabled in the daytime for several days.

It is another object of this invention to provide a battery voltage alarm circuit of the type set forth, which includes light-responsive means for automatically disabling the alarm signal in dark conditions and automatically reenabling the alarm signal in light conditions.

These and other objects of the invention are attained by providing in a battery voltage alarm circuit including means for comparing a first signal which is a function of the battery voltage to a relatively fixed reference signal and indicating means for providing an alarm output when the first signal is less than the reference signal to indicate low battery voltage, the improvement comprising control means for shifting the level of one of the first and reference signals for varying the difference therebetween thereby to vary the time at which the alarm output can occur.

DESCRIPTION OF THE PREFERRED EMBODIMENTS

Figure 1:
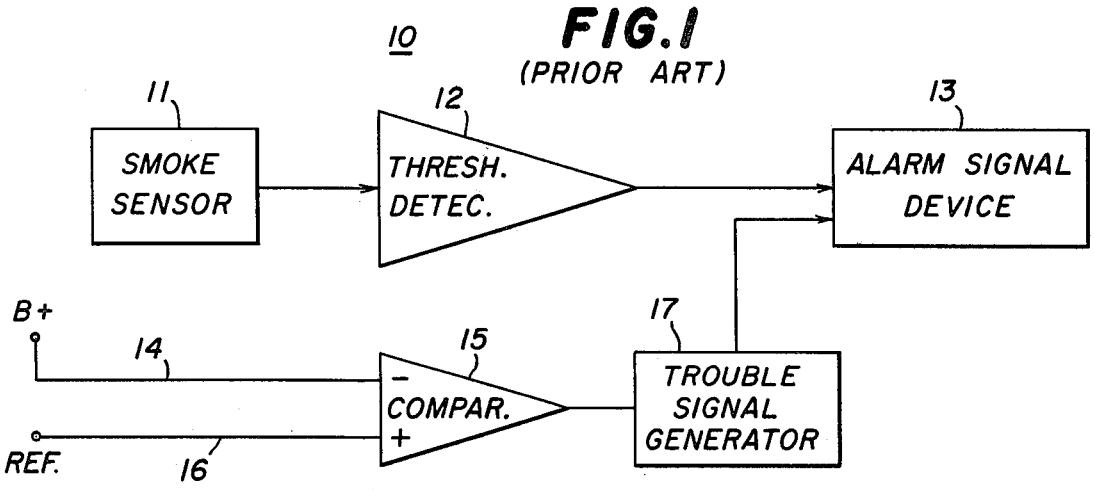
FIG. 1 (PRIOR ART)
FIG. 1 is a block diagram of a prior art combustion products detector unit.

Referring to FIG. 1 of the drawings, there is illustrated a prior art combustion products detector unit, generally designated by the numeral 10, which includes a smoke sensor 11, which may be of the photoelectric or radiation type, and is connected through a threshold detector 12 to an alarm signal device 13. The system is powered by a storage battery designated by the terminal B+, the B+ voltage also being applied via a conductor 14 to the inverting terminal of a comparator 15. A relatively constant voltage reference signal is applied via a conductor 16 to the noninverting terminal of the comparator 15. The output of the comparator 15 is connected to a trouble signal generator 17, the output of which is in turn connected to the input of the alarm signal device 13.

In operation, the smoke sensor 11 generates an electrical signal in the presence of smoke or other combustion products. If this signal exceeds a threshold level set by the threshold detector 12, a signal is transmitted to the alarm signal device 13 for producing an audible and/or visible smoke alarm signal. When the output voltage of the supply battery drops below the level of the reference signal, the comparator 15 produces an output signal which triggers the trouble signal generator 17 to produce a battery voltage alarm signal which causes the alarm signal device 13 to generate an audible alarm signal, which is preferably different from the smoke alarm signal, to indicate that the battery needs to be replaced. Typically, the battery voltage alarm signal will continue to be maintained either continuously or intermittently until the battery output voltage is insufficient to power the alarm circuitry.

Figure 2:
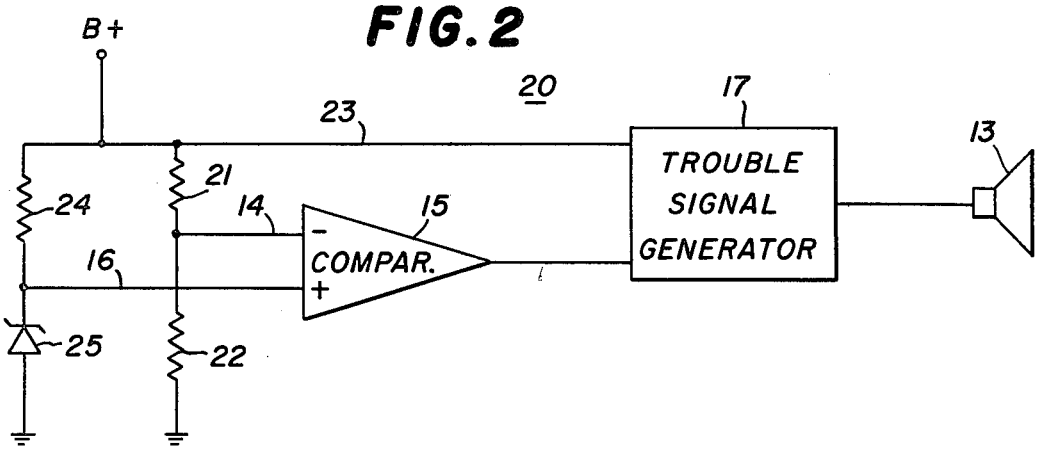
FIG. 2 is a partially block and partially schematic circuit diagram of a battery voltage alarm circuit for a combustion products detector.

Referring to FIG. 2, there is a more detailed circuit diagram of a battery voltage alarm circuit for use with a combustion products detector unit such as that shown in FIG. 1, this battery voltage alarm circuit being generally designated by the numeral 20. The positive battery terminal is connected via the conductor 23 directly to the trouble signal generator, and is also connected through the resistors 21 and 22 to ground. The resistors 21 and 22 form a voltage divider, the junction therebetween being connected via the conductor 14 to the inverting terminal of the comparator 15 to provide thereto a first signal which is a function of the battery output voltage. More particularly, this first signal is a divided portion of the battery output voltage equal to the ratio of the resistor 22 to the sum of the resistors 21 and 22.

The positive battery terminal is also connected through a resistor 24 to the cathode of a Zener diode 25 or similar device, the anode of which is grounded. The cathode of the Zener diode 25 is connected via the conductor 16 to the non-inverting terminal of the comparator 15 to provide thereto a reference signal, the voltage of which remains relatively constant as the output battery voltage decreases, by reason of the voltage regulating characteristics of the Zener diode.

Figure 3:
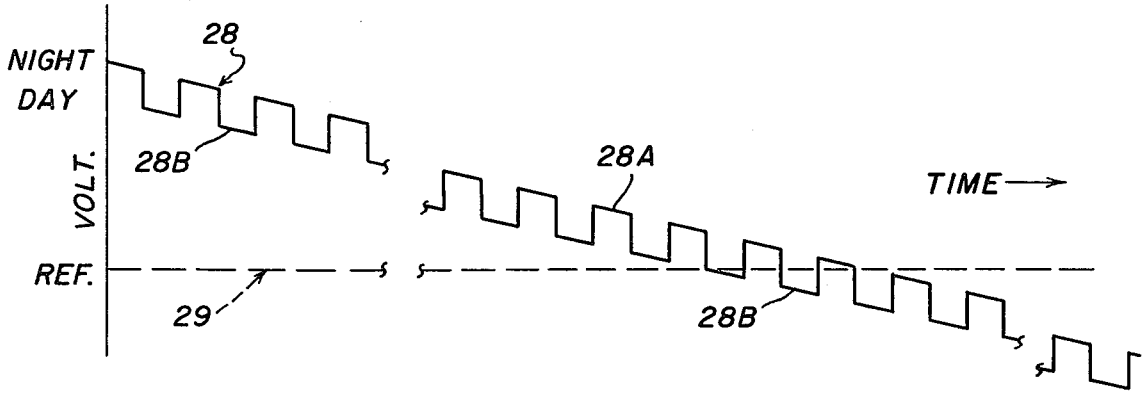
FIG. 3 is a graph showing the relationship between the reference signal and the normal and shifted output voltage signals of the circuits of FIGS. 2 and 5.

Referring also to FIG. 3 of the drawings, the values of the resistors 21, 22 and 24 are set so that when the battery is fully charged, the first signal on the conductor 14, designated 28 in FIG. 3, will normally be substantially greater than the reference signal on the conductor 16, designated 29 in FIG. 3. As long as this condition prevails, there will be no output from the comparator 15 and, therefore, the trouble signal generator 17 will not be activated. As the output voltage of the battery decreases, the signal 28 will correspondingly decrease and, when it falls below the level of the reference signal 29, the comparator 15 will produce an output signal, causing the trouble signal generator 17 to generate a battery voltage alarm signal. Preferably, the reference signal 29 is set at a level slightly above the minimum voltage which can drive the combustion products detector unit 10, so as to give a certain amount of advance warning before the unit 10 ceases to function.

It will be appreciated that the battery voltage alarm signal could occur at any time of the day or night, and it would be particularly inconvenient and annoying if it occurred in the middle of the night. Thus, the present invention provides a means for guaranteeing that the battery voltage alarm signal will begin and continue only during the daytime or normal waking hours, and will be discontinued during the nighttime or sleeping hours.

Figure 4:
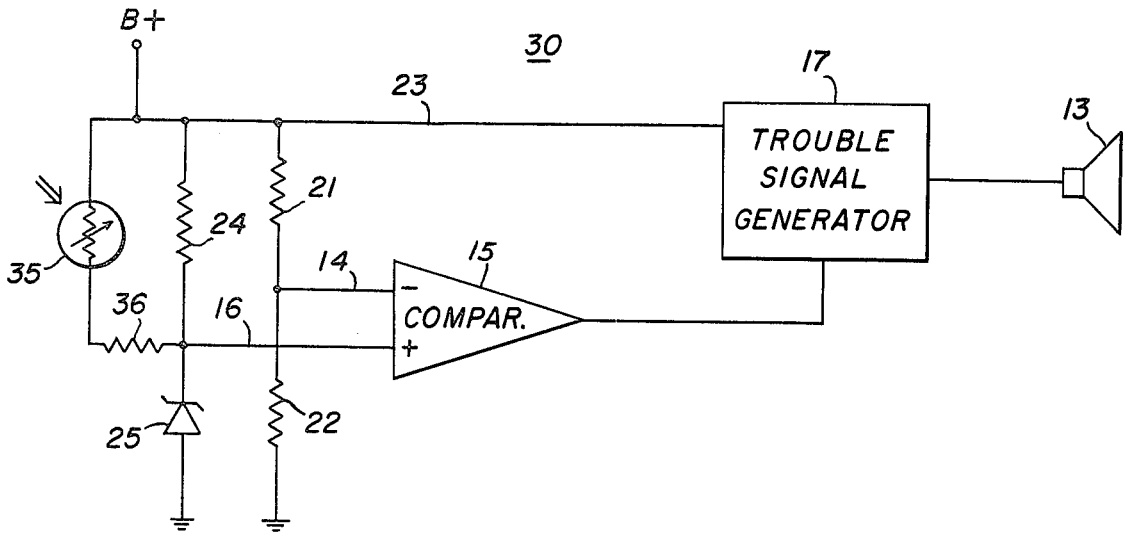
FIG. 4 is a partially block and partially schematic circuit diagram, similar to FIG. 2, showing a battery voltage alarm circuit including photosensitive means for automatically shifting the level of the reference signal in response to changes in ambient light conditions.

Referring now to FIG. 4 of the drawings, there is shown a first embodiment of battery voltage alarm circuit of the present invention, generally designated by the numeral 30, which achieves the desired result by shifting the level of the reference signal to the comparator 15 between a relatively high daytime level and a relatively low nighttime level. More particularly, the battery voltage alarm circuit 30 is similar to the circuit 20 illustrated in FIG. 2, with the exception that there has been added in parallel with the resistor 24, the series combination of a photoresistor 35 and a fixed resistor 36. The photoresistor 35 is preferably a CdS or CdSe photoresistive cell, which exhibits a very high impedance, in the range of about 10 Mohms, under dark conditions, and a relatively low resistance, in the range of about 2 Kohms, under light conditions, i.e., typical ambient levels of sunlight or artificial light.

Figure 6:
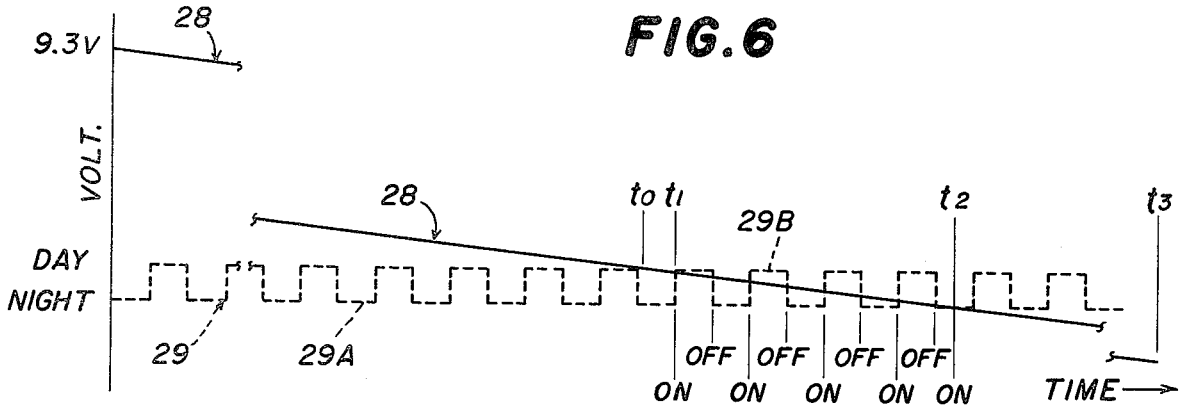
FIG. 6 is a graph similar to FIG. 3, illustrating the relationship between the battery output voltage signal and the shifted reference signal.

In a constructional model of the battery voltage alarm circuit 30, the resistor 24 may have a value of 1 Mohms, while the resistor 36 may have a value of about 100 Kohms. Accordingly, by the familiar rules for calculating parallel impedances, it will be appreciated that the total resistance in series with the Zener diode 25 is substantially less during light conditions than during dark conditions. Thus, the daytime current through the Zener diode 25 will be substantially greater than that at night. Applying generally known and understood principles of Zener diode operations, it follows that the reference signal 29, which is the voltage across the Zener diode, will be at a level 29B during the light hours, which is relatively greater than the level 29A during the dark hours, as is indicated in FIG. 6. It will be appreciated that the effect of this shifting in the level of the reference signal is to make the gap between the reference signal and the first signal 28 greater at night than during the day.

From FIG. 6 is can be seen that the first signal 28, which is a function of the battery output voltage, decreases below the daytime level 29B of the reference signal 29 at a time $t_0$. But since the time $t_0$ falls at night, the reference signal 29 is at its lower nighttime level 29A and, therefore, the comparator 15 is not activated to produce an output signal. At time $t_1$, the reference signal 29 shifts back up to its daytime level 29B in response to either daylight or artificial light shining on the photoresistor 35 and changing the resistance thereof. Thus, at time $t_1$ the first signal 28 is below the reference signal 29, and an output signal will be produced by the comparator 15 for generating an alarm signal from the trouble signal generator 17. It will be understood that each night, when the ambient light is removed from the photoresistor 35, the reference signal 29 will shift back to its low nighttime level 29A, which is below the level of the first signal 28, and the alarm signal will turn off.

The battery voltage alarm signal will continue turning on during the day and turning off at night either until the battery is replaced, or until the battery voltage has decreased to a point where the first signal 28 falls below the nighttime level 29A of the reference signal, as at time $t_2$. From time $t_2$ onward, the first signal 28 will always be below the reference signal 29, regardless of its level, and the alarm signal will therefore remain on continually until the output voltage of the battery is insufficient to drive the battery voltage alarm circuit 30, as at time $t_3$. Preferably, the difference between the daytime and nighttime levels 29B and 29A of the reference signal 29 is set at a distance such that the interval between time $t_1$ and $t_2$ is several days, thereby insuring that the user will detect the alarm signal, even if he is absent from the home for a few days.

Figure 5:
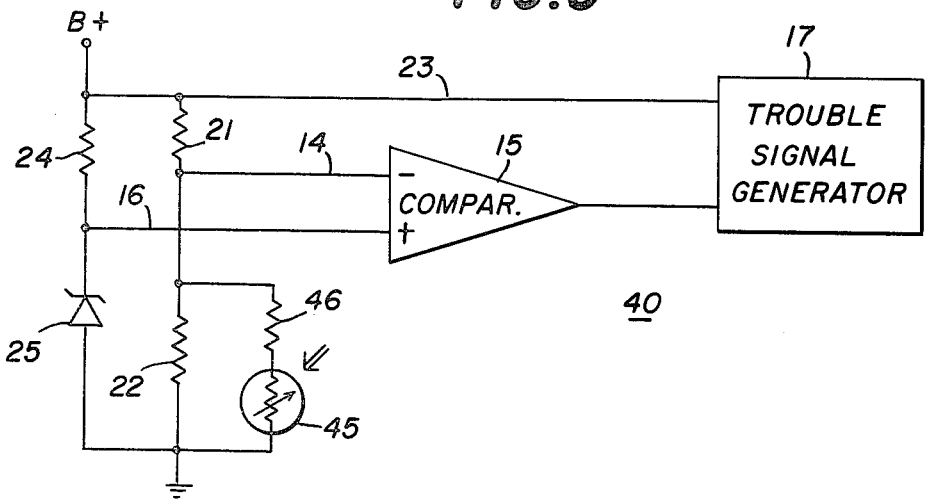
FIG. 5 is a view similar to FIG. 4 of another embodiment of the invention, including photoresistive means for automatically shifting the level of the battery voltage output signal in response to changes in ambient light conditions.

Referring now to FIG. 5 of the drawings, there is illustrated another embodiment of the battery voltage alarm circuit of the present invention, generally designated by the numeral 40. The circuit 40 is similar to the circuit 20 of FIG. 2, with the exception that there has been added in parallel with the resistor 22, the series combination of a photoresistor 45 and a fixed resistor 46. The photoresistor 45 is preferably the same type as the photoresistor 35 described in connection with FIG. 4. In a constructional model of the circuit 40, the resistors 21 and 22 may each be 100 Kohms, while the resistor 46 is 500 Kohms.

In operation, during dark conditions, the total resistance of the resistors 22 and 46 and the photoresistor 45 will be greater than their total resistance in light conditions. Thus, referring to FIG. 3, during dark conditions the first signal 28 fed to the comparator 15 on the conductor 23 will be at a relatively high level 28A, while during light conditions the level of the first signal will be lowered to a level 28B, thereby effectively increasing the battery output voltage at which the alarm signal will occur. It will be appreciated that the lowering of the level of the first signal 28 with respect to the reference signal 29 has the same effect as raising of the reference signal with respect to the first signal, and vice versa. The first signal 28 will periodically shift between the nighttime and daytime levels 28A and 28B until the battery is replaced or until the output voltage of the battery drops below the level necessary for driving the battery voltage alarm circuit 40.

From the foregoing, it can be seen that there has been provided an improved battery voltage alarm circuit which is automatically programmed to deactuate the alarm circuitry during dark conditions or normal sleeping hours and to actuate the alarm circuitry during light conditions or normal waking hours and to continually shift between these actuated and deactuated conditions for several days or until the battery is replaced.

There has also been provided such a programmed battery voltage alarm circuit which avoids the difficulties of prior art systems and, yet, is of simple and economical construction.

While there have been described what are at present considered to be the preferred embodiments of the invention, it will be understood that various modifications may be made therein, and it is intended to cover in the appended claims all such modifications as fall within the true spirit and scope of the invention.

What is claimed is:

1. In a battery voltage alarm circuit including means for comparing a first signal which is a function of the battery voltage to a relatively fixed reference signal and indicating means for providing an alarm output when the first signal is less than the reference signal to indicate low battery voltage, the improvement comprising condition-responsive control means for automatically shifting the level of one of the first and reference signals for varying the difference therebetween thereby to vary the time at which the alarm output can occur.

2. The battery voltage alarm circuit of claim 1, wherein said control means includes variable impedance means.

3. The battery voltage alarm circuit of claim 1, wherein said control means includes means for shifting the level of the first signal.

4. The battery voltage alarm circuit of claim 1, wherein said control means includes means for shifting the level of the reference signal.

5. The battery voltage alarm circuit of claim 1, wherein said control means includes photosensitive means for shifting the level of one of the first and reference signals in response to changes in ambient light conditions.

6. A battery voltage alarm circuit for indicating when the output voltage of a battery falls below a predetermined level, said alarm circuit comprising first signal generating means connected to the battery for producing a first signal which is a function of the output voltage of the battery, second signal generating means connected to the battery for producing a relatively constant-voltage reference signal, and indicating means connected to said first and second signal generating means for comparing said first signal with said reference signal and producing an alarm output signal when said first signal is less than said reference signal, said second signal generating means including condition-responsive variable impedance means for automatically shifting the constant-voltage level of said reference signal thereby to vary the difference between said first and reference signals for varying the time at which the alarm output signal can occur.

7. The battery voltage alarm circuit of claim 6, wherein said second signal generating means includes a Zener diode connected in series with said variable impedance means across the battery, said reference signal being the voltage across said Zener diode.

8. The battery voltage alarm circuit of claim 6, wherein said variable impedance means includes photosensitive means for shifting the level of said reference signal in response to changes in ambient light conditions.

9. The battery voltage alarm circuit of claim 6, wherein said second signal generating means comprises a fixed resistance and a Zener diode connected in series across the battery, and photoresistive means connected in parallel with said fixed resistance, said photoresistive means having a high resistance in dark conditions and a low resistance in light conditions, whereby the current through said Zener diode is effectively decreased in dark conditions for decreasing said reference signal and inhibiting the generation of said alarm output signal.

10. A battery voltage alarm circuit for indicating when the output voltage of a battery falls below a predetermined level, said alarm circuit comprising first signal generating means connected to the battery for producing a first signal which is a function of the output voltage of the battery, second signal generating means connected to the battery for producing a relatively constant-voltage reference signal, and indicating means connected to said first and second signal generating means for comparing said first signal with said reference signal and producing an alarm output signal when said first signal is less than said reference signal, said first signal generating means including condition-responsive variable impedance means for automatically shifting the level of said first signal thereby to vary the difference between said first and reference signals for varying the time at which the alarm output signal can occur.

11. The battery voltage alarm circuit of claim 10, wherein said first signal generating means comprises a voltage divider including a fixed resistance connected in series with said variable impedance means across the battery, said first signal being the voltage across said variable impedance means.

12. The battery voltage alarm circuit of claim 11, wherein said variable impedance means comprises a fixed resistance in parallel with a variable resistance.

13. The battery voltage alarm circuit of claim 11, wherein said variable impedance means comprises a fixed resistance in parallel with photoresistive means for varying the level of said first signal in response to changes in ambient light conditions.

* * * * *